US012421711B2

(12) United States Patent
Atterstrom

(10) Patent No.: US 12,421,711 B2
(45) Date of Patent: Sep. 23, 2025

(54) METHOD FOR USING AERATED AUTOCLAVED CONCRETE IN RESIDENTIAL AND COMMERCIAL CONSTRUCTION

(71) Applicant: The PAAC-Tech Response, LLC, Plano, TX (US)

(72) Inventor: James Atterstrom, Flower Mound, TX (US)

(73) Assignee: The PAAC-Tech Response, LLC, Plano, TX (US)

( * ) Notice: Subject to any disclaimer, the term of this patent is extended or adjusted under 35 U.S.C. 154(b) by 564 days.

(21) Appl. No.: 17/807,746

(22) Filed: Jun. 20, 2022

(65) Prior Publication Data

US 2022/0403641 A1 Dec. 22, 2022

Related U.S. Application Data

(60) Provisional application No. 63/202,683, filed on Jun. 21, 2021.

(51) Int. Cl.

| | |
|---|---|
| ***E04B 1/04*** | (2006.01) |
| ***E04B 1/16*** | (2006.01) |
| ***E04B 2/00*** | (2006.01) |
| ***E04B 5/02*** | (2006.01) |
| ***E04C 2/04*** | (2006.01) |

(Continued)

(52) U.S. Cl.

CPC ..... *E04B 1/043* (2013.01); *E04B 1/165* (2013.01); *E04C 2/044* (2013.01); *E04C 2/46* (2013.01); *E04C 2/50* (2013.01); *E04G 13/02* (2013.01); *E04G 13/04* (2013.01); *E04G 17/0655* (2013.01); *E04B 2103/02* (2013.01)

(58) Field of Classification Search

CPC ..... E04B 1/043; E04B 1/165; E04B 2103/02; E04C 2/044; E04C 2/46; E04C 2/50; E04G 13/02; E04G 13/04; E04G 17/0655; E04G 21/165

USPC ..... 52/233

See application file for complete search history.

(56) References Cited

U.S. PATENT DOCUMENTS 2,014,576 A * 9/1935 Leggat ..... E04B 2/58 52/285.2

3,578,309 A * 5/1971 Freedman ..... E04G 17/06 249/43

(Continued)

*Primary Examiner* — Brian D Mattei

*Assistant Examiner* — Joseph J. Sadlon

(74) *Attorney, Agent, or Firm* — KLEMCHUK PLLC

(57) ABSTRACT

A method for construction using a panel and plank system that may optionally be made of Aerated Autoclaved Concrete (AAC), wherein wall panels are delivered, erected and attached to structural forms and braced with properly designed shoring/struts with form ties and specifically designed "panel ties". Intermediate bracing is installed at midspan locations where spans are short and there is a possibility of wall buckling. Floor/roof planks are set on top of the walls being cognizant of bearing surface requirements. The deformed and post-tension reinforcing steel is set/installed and any miscellaneous detailing is completed. Thin AAC panels can be installed as form liners for added insulation where dimensions accommodate them. Structural grout or small aggregate concrete is placed, consolidated/vibrated, and finished and allowed to cure to minimum required strengths. Roof pours are given a "crown" to allow proper drainage.

18 Claims, 16 Drawing Sheets

(51) Int. Cl.

| | |
|---|---|
| ***E04G 13/02*** | (2006.01) |
| ***E04G 13/04*** | (2006.01) |
| ***E04G 17/065*** | (2006.01) |
| *E04G 21/16* | (2006.01) |

(56) References Cited

U.S. PATENT DOCUMENTS 3,617,047 A * 11/1971 Holt ..... E04G 13/025 269/287
3,672,626 A * 6/1972 Thornton ..... E04G 11/12 249/48
4,137,684 A * 2/1979 Shennan ..... E04C 2/382 52/97
4,409,764 A * 10/1983 Wilnau ..... E04B 1/165 52/204.2
4,424,951 A * 1/1984 Spencer ..... E04G 13/021 425/441
4,604,250 A * 8/1986 Ecker ..... E04G 13/02 249/90
4,805,366 A * 2/1989 Long ..... E04C 2/288 249/40
5,016,855 A * 5/1991 Huggins ..... E04G 13/04 249/20
5,507,427 A * 4/1996 Burgett ..... C04B 18/26 264/269
5,673,525 A * 10/1997 Keith ..... F16B 19/14 411/487
6,082,074 A * 7/2000 Shaw ..... B28B 1/008 249/34
6,189,278 B1 * 2/2001 Stegmeier ..... E04G 13/04 249/188
6,338,231 B1 * 1/2002 Enriquez ..... E04C 2/382 52/258
7,146,773 B2 * 12/2006 Wilson ..... E04B 2/8629 52/223.6
7,226,033 B2 * 6/2007 Foucher ..... E04B 1/0023 52/270
7,568,676 B2 * 8/2009 Takagi ..... E04G 17/0655 249/47
7,607,274 B1 * 10/2009 Gillen ..... E04B 1/04 52/79.11
7,632,437 B2 * 12/2009 Gullette ..... E04G 13/02 249/48
7,975,444 B2 * 7/2011 Holdsworth ..... E04B 1/043 52/565
8,181,418 B2 * 5/2012 Barnet ..... E04G 21/142 52/127.2
8,240,103 B2 * 8/2012 Riepe ..... E04B 1/4178 52/309.4
8,671,637 B2 * 3/2014 LeBlang ..... E04B 1/14 52/309.4
8,863,445 B2 * 10/2014 Zhong ..... E04B 1/34823 52/79.14
8,978,333 B2 * 3/2015 Potter ..... E04C 2/049 52/582.1
9,574,347 B2 * 2/2017 Thiercelin ..... E04C 2/46
9,637,870 B1 * 5/2017 Coe ..... C08L 21/00
9,745,739 B2 * 8/2017 Riepe ..... E04B 1/4178
10,066,383 B1 * 9/2018 Perasso ..... E04B 1/167
10,094,101 B1 * 10/2018 Jazzar ..... E04C 3/34
10,094,110 B2 * 10/2018 Gomes ..... E04B 2/22
10,344,480 B2 * 7/2019 Azizinamini ..... E04C 3/20
10,415,241 B2 * 9/2019 Simonson ..... E04C 5/01
10,472,823 B2 * 11/2019 Chevis ..... E04B 2/8629
10,753,088 B2 * 8/2020 Mirkhani ..... E04B 7/00
10,822,786 B2 * 11/2020 Jackson ..... E04B 2/58
11,230,837 B2 * 1/2022 Shumate ..... B28C 7/003
11,352,780 B2 * 6/2022 Foster ..... E04C 2/049
11,598,091 B2 * 3/2023 Mirkhani ..... E04B 1/16
11,851,897 B2 * 12/2023 Bellissimo ..... B27M 3/04
2001/0023733 A1 * 9/2001 Gregg ..... C04B 38/02 156/45
2002/0174606 A1 * 11/2002 Hunt ..... E04C 2/521 52/561
2005/0066592 A1 * 3/2005 Huber ..... E04G 13/021 52/169.9
2006/0080938 A1 * 4/2006 Rothdach ..... B28B 11/22 52/749.13
2006/0156675 A1 * 7/2006 Nelson ..... E04G 17/002 52/633
2006/0179787 A1 * 8/2006 Bilowol ..... E04G 9/10 52/741.11
2007/0062134 A1 * 3/2007 Chung ..... E04B 1/165 52/293.3
2008/0022618 A1 * 1/2008 Jessop ..... E04G 17/14 52/375
2009/0107065 A1 * 4/2009 LeBlang ..... E04B 1/80 52/309.4
2010/0242403 A1 * 9/2010 Brewka ..... E04G 17/007 249/48
2012/0031027 A1 * 2/2012 Burks ..... E04H 9/14 52/745.12
2014/0237910 A1 * 8/2014 Hunt ..... E04B 7/20 52/79.14
2014/0306088 A1 * 10/2014 Dryburgh ..... B22C 9/064 249/13
2015/0308096 A1 * 10/2015 Merhi ..... E04G 21/14 52/745.1
2016/0215511 A1 * 7/2016 Salekärr ..... E04C 2/46
2021/0252683 A1 * 8/2021 Chevis ..... F16B 37/122
2021/0324629 A1 * 10/2021 Brinton ..... E04B 1/80

* cited by examiner

METHOD FOR USING AERATED AUTOCLAVED CONCRETE IN RESIDENTIAL AND COMMERCIAL CONSTRUCTION

CROSS REFERENCE TO RELATED APPLICATIONS

This application is a non-provisional of and claims priority to U.S. Provisional Patent Application No. 63/202,683 filed on Jun. 21, 2021, which is incorporated by reference in its entirety.

TECHNICAL FIELD

The present disclosure relates to panel and plank construction, and more particularly, to a method for assembling a structure using panels and planks that are made of Aerated Autoclaved Concrete (AAC).

BACKGROUND

Aerated autoclaved concrete (AAC) is construction material made from: water, sand, cement, lime, and a small amount of a safe propriety. AAC is manufactured in components of hand-laid blocks, larger machine-laid blocks, wall panels, and floor and roof planks. Because of the physical properties of AAC components, the inherent costs to stage, assemble and reinforce these AAC components makes their use cost prohibitive in many structures—especially in residential home units and other structures in logistically challenged and remote locations: Areas which are in desperate need of an alternative to labor-intensive, costly, conventional wood-framed, metal framed, concrete block or other construction.

SUMMARY

Disclosed is a method to construct and assemble an integral monolithic superstructure using panels and planks, where at least the panels, and optionally the planks, are made of aerated autoclaved concrete (AAC).

The method can include placing a first set of construction materials that include planks, panels, or planks and panels on a construction site to form one or more vertical walls of the integral monolithic superstructure; placing a second set of construction materials that include planks, panels, or planks and panels on a top edge of the first set of construction materials to form a horizontal surface of the integral monolithic superstructure; and casting one or more beams, corners, columns, toppings or combinations thereof, wherein each of the beams, corners, columns, topping, or combinations thereof is adjacent to at least one plank or panel of the first set of construction materials and at least one plank or panel of the second set of construction materials. The method can include, after placing the first set and prior to placing the second set, setting forms, struts, bracing, shoring, anchors, or combinations thereof at points along the first set of construction materials to hold the first set of construction materials in place.

The method can include, before placing the first set of construction material, manufacturing the first set of construction materials and the second set of construction materials. The method can include after manufacturing and prior to placing the first set, reverse staging of panels and planks on delivery transportation vehicles at the factory, and ends with cost-effective, low maintenance finishes of the installed materials. The intermediate steps/stages of; delivery, assembly, temporary safe shoring, forming of the internal/integral cast-in-place structural grout superstructure (the "Integral Monolithic Superstructure" or "IMS"), all combine to result in quick, safe, construction schedule and structure with properties that are far superior to conventional framing and cast in place concrete. The IMS can be developed, adapted, or conceptually designed for a more conducive application of the System. The AAC manufacturer can adjust their product characteristics (compressive strengths and internal reinforcing), and a structural engineer designs the "Integral Monolithic Superstructure" ("IMS"), to accommodate the performance standards of the structure. The planks and panels can be manufactured or factory-cut to standardized dimensions (but minimizing the number of unique dimensions) required for assembly, which eliminates the method of field cutting the planks and panels to fit. Standard sizing of the planks and panels also allows for the interchangeability of panels or planks. The panels and planks can be "reverse staged" (last loaded on the truck are the first set on site) on delivery vehicles so that (when construction site conditions permit), the panels and planks can be picked from the truck and set directly in place.

Prior to delivery of materials, an appropriately designed foundation or substructure (see below) is design and constructed. Forms and structural shoring/struts using the disclosed ties and connections, are set/erected in strategic locations, that serve two purposes: to function as forms for the cast-in-place structural grout/concrete mix for the IMS; and to plumb and temporarily and safely brace and shore the wall systems. This allows erection of the walls and floors, continuously without interruption, and without the typical use of a permanent external superstructure.

The panels are delivered, erected and attached to the structural forms and braced with properly designed shoring/struts with form ties, specifically designed "Panel Ties" and standard AAC fasteners. The panels can form one or more vertical forms of the IMS. Intermediate wall bracing/stiffeners/shoring/struts is installed at midspan locations where spans are long and wall panels are narrow and there is a possibility of wall buckling.

The planks are set on top of the walls being cognizant of bearing surface requirements. Temporary midspan shoring may be used for longer plank spans that utilize thinner planks where planks may deflect during construction. The deformed and post-tension reinforcing steel is set/installed and any miscellaneous detailing is completed. The planks can form a horizontal surface of the IMS.

Remaining wall and perimeter/ring beam forms and ties are installed. Thin panels can be installed as form liners for added insulation where dimensions accommodate them. Bond breaker and expansion joint materials may also be installed to arrest/isolate cyclical movement and mitigate panel cracking. Structural grout or small aggregate concrete is placed, consolidated/vibrated, finished, and allowed to cure to minimum required strengths. Roof pours are given a "crown" to allow proper drainage.

Forms, bracing, shoring, anchors, and struts are removed. Concrete is patched, an additional thin layer of cladding (e.g., AAC cladding) can be applied over exposed concrete to provide added insulation. The finished structure easily accepts durable, cost effective, long lasting finish, that can be quickly applied. The AAC can also accept traditional finishes like masonry, composite siding, and fully adhered veneer stone products.

Since the materials are durable, sustainable, inert, fireproof, and can resist higher wind loads than conventional residential construction, clean-up after a major destructive incident (flood, fire, storm, etc.), is relatively quick and inexpensive. Simply empty the space of belongings and collateral debris, shovel the remaining sediment, and using a high-volume water hose, rinse the structure clean (inside and out), wash the surfaces with a sanitizer, and dry to prepare for occupancy again. This has the potential to not only reduce the cost of insurance claims drastically, but may in some cases can prevent them.

Other technical features may be readily apparent to one skilled in the art from the following figures, descriptions and claims.

BRIEF DESCRIPTION OF THE DRAWINGS

For a more complete understanding of this disclosure, reference is now made to the following description, taken in conjunction with the accompanying drawings, in which.

DETAILED DESCRIPTION

Figure 1:
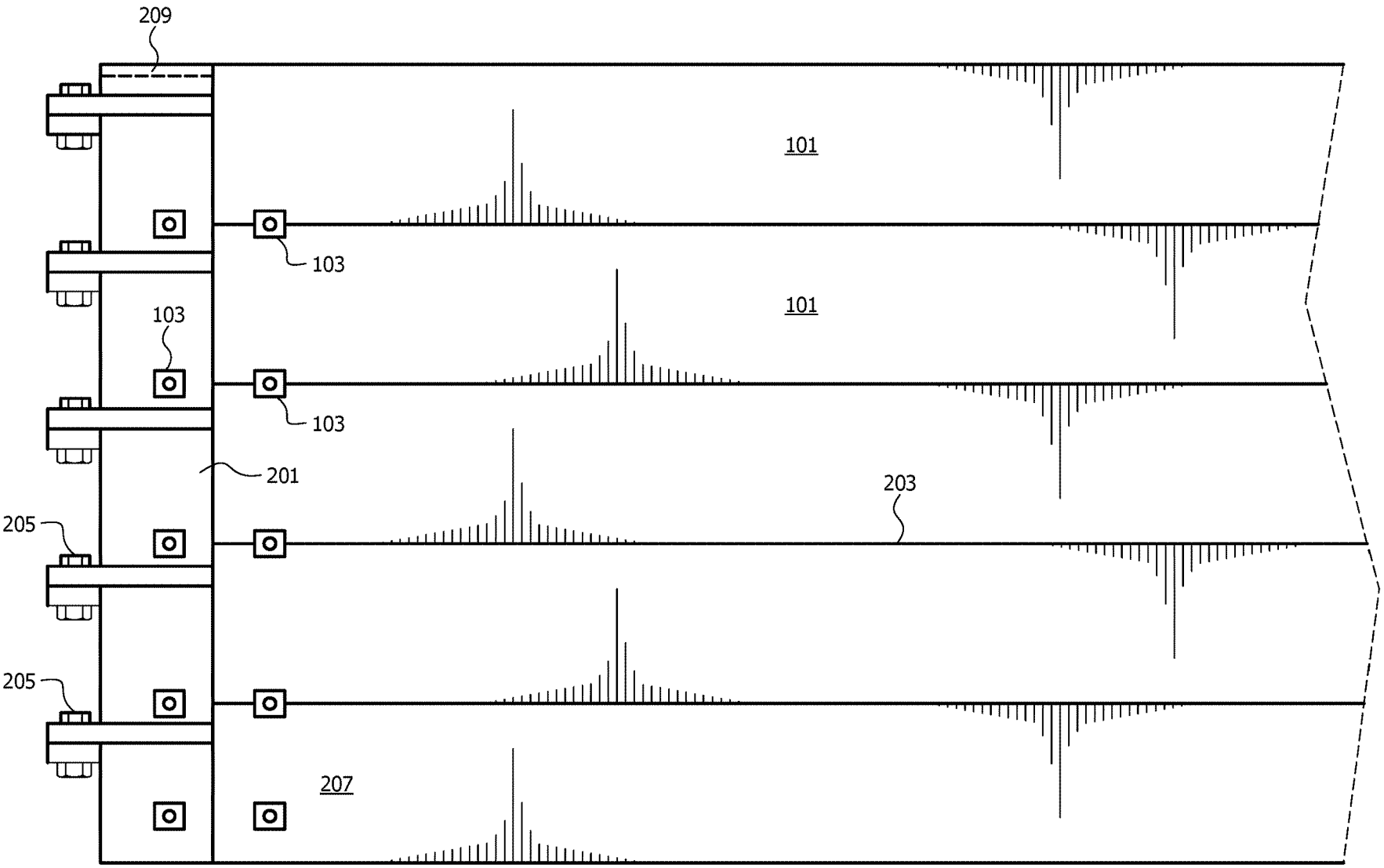
FIG. 1 depicts a front elevational view of a wall at an outside corner with forms according to an embodiment of the present disclosure.

Disclosed herein is a method to construct and assemble an integrated monolithic superstructure using panels and planks, where the panels, planks, or both panel and planks are made of aerated autoclaved concrete (AAC).

The method can include developing a structure that is conceptually designed for a more conducive application of the System. An assessment of purpose, required design criteria, space needs, etc. and the development of the conceptual design should be guided in a manner that is conducive the use of this system. If the design is already conceptually established, then a skilled, properly trained architect, engineer, qualified contractor, or AAC rep should assess the conceptual design and design criteria and make recommendations that render the use of the system more practical for the specific application.

The AAC manufacturer adjusts their product characteristics (compressive strengths and internal reinforcing requirements), the manufacturer can design material characteristics to meet thermal and compressive strength requirements for the building and local code criteria/standard. Top wall panels should have a higher compressive strength where needed to accommodate live and dead loads during construction activities. A structural design technician designs the IMS to accommodate the performance standards of the structure, the performance standards, and deflection criteria of the substructure to minimize failures or cracking. Bearing soils tests are always required.

The AAC planks and panels are manufactured in the factory, then cut to exact dimensions (but minimizing the number of unique dimensions) required for assembly to eliminate the process of field cutting to fit. Standard sizes can be used, which also allows for the interchangeability of panels or planks. Pre-cutting to exact lengths at the factory allows for fashioning panels/planks in an environment with the facilities to perform fashioning quicker and more efficiently. Pre-cutting also allows the field erectors to work quickly and without delays caused by custom field cuts. Limited Uniform sizes, consistent with typical residential room dimensions, allow for easy staging on delivery vehicles, easy interchangeability of damaged or missing panels/planks, and easy coordination at the jobsite. Limited Uniform sizes also allows AAC distributors to stock panels and planks, which would otherwise be considered "custom manufactured" and potentially eliminate delays caused by remanufacturing of damaged or missing panels and planks.

Panels and planks are "reverse staged" (last loaded on the truck are the first set on in place on site) on delivery vehicles so that, when construction site conditions permit, panels and planks can be picked from the truck and set directly in place. AAC is a low strength concrete that is damaged relatively easily. Repairs can be made but take time and cause delays. Reduced handling means a reduced risk of damage and delays. Moving materials multiple times takes time and causes delays. Reverse staging on delivery vehicles mean products can be set in place right from the delivery vehicles, eliminating delays caused by staging materials multiple times, and the cost of repairing damage caused by excessive handling. Dual tandem, short-wheel-based, soft-ride trailers allow delivery to areas where road access is tight (such as residential neighborhoods) because one trailer can be dropped, while one is delivered, and minimizing damage from transport.

Prior to delivery of components an appropriate design foundation or substructure is constructed. AAC is non-ductile—it will only accommodate a minimum amount of deflection before it cracks, this is especially true for wall panels. The performance standards and deflection criteria of the substructure should be such that it minimizes failures or cracking. Bearing soils tests are always required to determine substructure design criteria. Additionally, bond-breaking materials and thin expansion joint materials are used in strategic locations. These materials help arrest and isolate potential movement throughout the IMS wall system. They also mitigate cracking caused by the thermal expansion and contraction differentials of the different materials.

Figure 6:
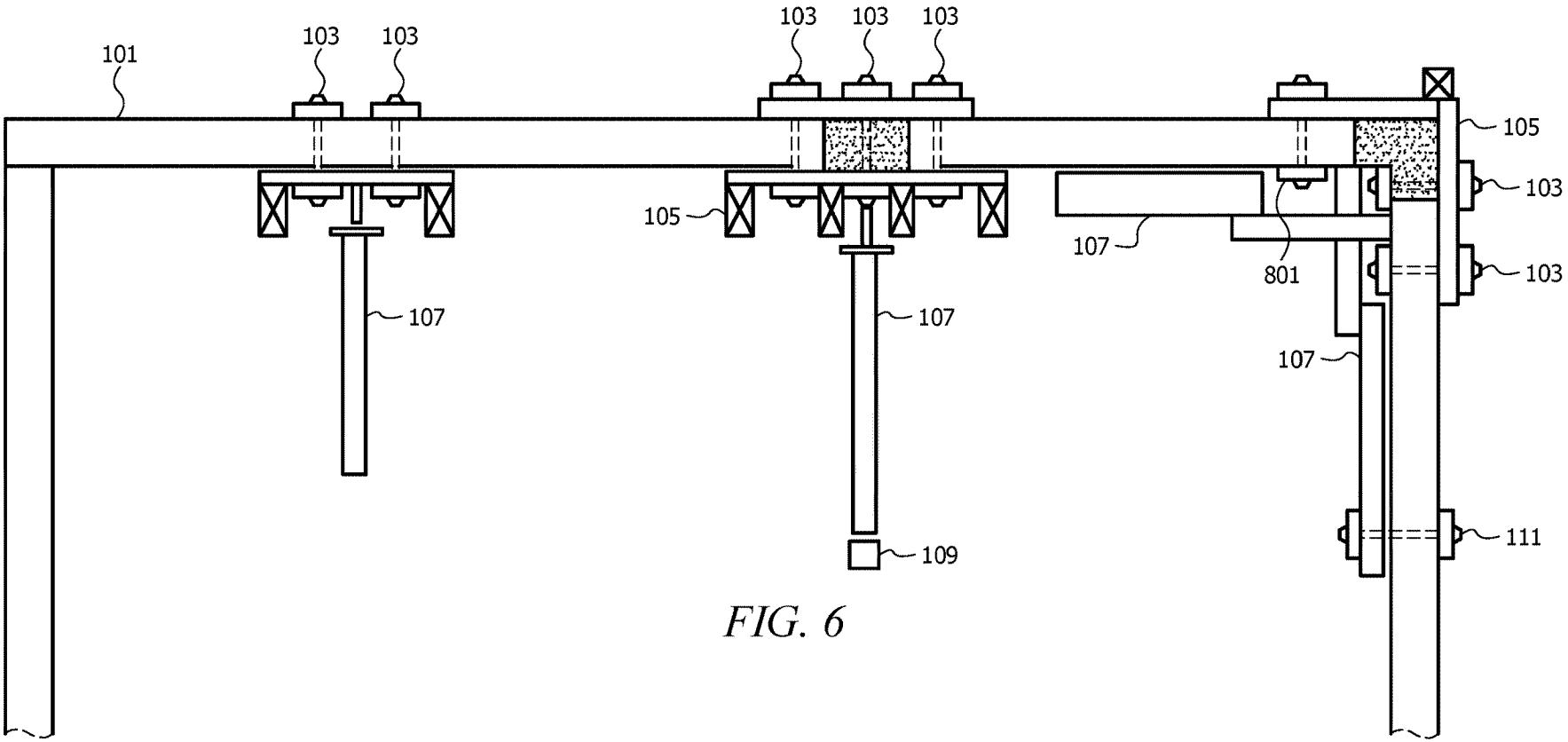
FIG. 6 depicts a plan view of a panel wall system with forms according to an embodiment of the present disclosure.

Prior to placing any wall panels, vertical wall forms are erected at strategic locations (corners, mid-wall integral columns, and as mid span bracing to prevent buckling on longer wall spans). They are set, braced, and plumbed using a combination of rigid or cable struts and shores, and specially designed ties and connections 205. Shoring and braces are anchored to the substructure or flooring system using properly designed removable anchors, or adjacent wall panels. These forms and braces serve two purposes: to function as forms for the cast-in-place structural grout/concrete mix for the IMS, and to plumb and temporarily and safely brace and shore the wall systems, and allows for planks to safely bear on panel walls. The forms and braces hold the panels in an arrangement that is in accordance with the floor plan. One of the key factors of the system is the monolithic casting of the entire Internal/Integral Monolithic Structure Superstructure at one time. The forms "sandwich" the ends of the panels (one form on the outside face and one on the inside face) and are held in place with "through-wall" "form ties" at each horizontal panel joint. The form ties can be re-usable or disposable snap ties, or re-usable She-Bolt, Wing-Nut or other removable through wall or sleeved tie. The forms are specifically designed with elongated and oversized "form tie" holes at panel joint locations to accommodate a limited amount of field tolerance deviations, and to allow the walls to be re-plumbed after the panels are in erected. This is important because the floor and roof planks can be cut to size at the factory, and the bearing requirements for the end of the panels is specific. Field adjustment capabilities are needed to make sure that the distance between the tops of the bearing walls is exact. Plumbing, temporarily and safely bracing, and shoring the wall systems allows erection of the wall panels and floor planks continuously without interruption, and without the use and cost of a permanent external superstructure. As shown in FIG. 6, these forms & struts, creating form systems 105, st securely brace/shore the walls to prevent any movement or buckling (or other failure) while the floor planks are set on the top edge of the walls. This is important because workers can be working on the planks that have not been secured in place by the IMS. Struts are anchored to forms/shoring and are secured to the concrete slab or foundation using an imbedded receiver with a removable anchor 109, or expansion anchor or shield. Struts may also be through-bolted 111 to the bottom panel near the slab and adjacent to a perpendicular panel wall. Corner Forms can be set with the inside corner set on a ¼" to ½" removable pivot shim, or embedded levelling bolt to allow the contractor to "plumb" walls and where necessary, tilt walls inward to meet minimum surface bearing areas for the planks that rest on the tops of the walls. Take "as-built" elevations at any location where panels can be set. Concrete should be flat and level. Surface needs to be within +/−⅛" of 10 feet in elevation to prevent point loads and spalling, or panel deflection. One way to assure the surface is within the parameters is to install chamfers trips at the exact grade of the concrete along the interior surface of the perimeter beam forms. If the bearing surface is not precise, then obtain exact as-built elevations, determine the highest point of the perimeter of the slab, set glazing shims at 10' o.c. set to the exact elevation of the highest point, lay a bed of mortar in between shim locations, and use a concrete screed to create a precise bearing surface for the panels.

Figure 5:
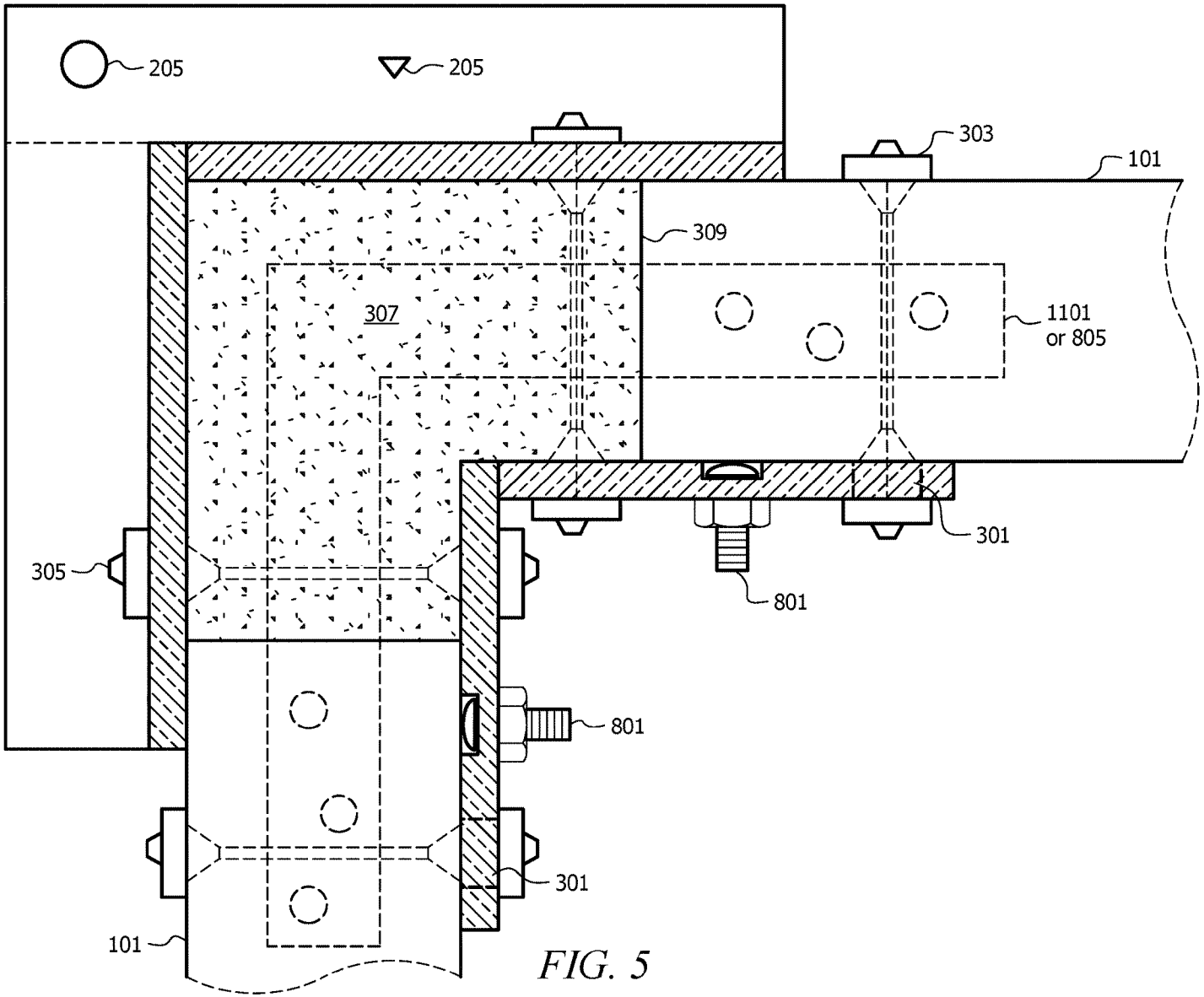
FIG. 5 depicts a plan view of a corner of the wall of FIG. 1 according to an embodiment of the present disclosure.
Figure 12:
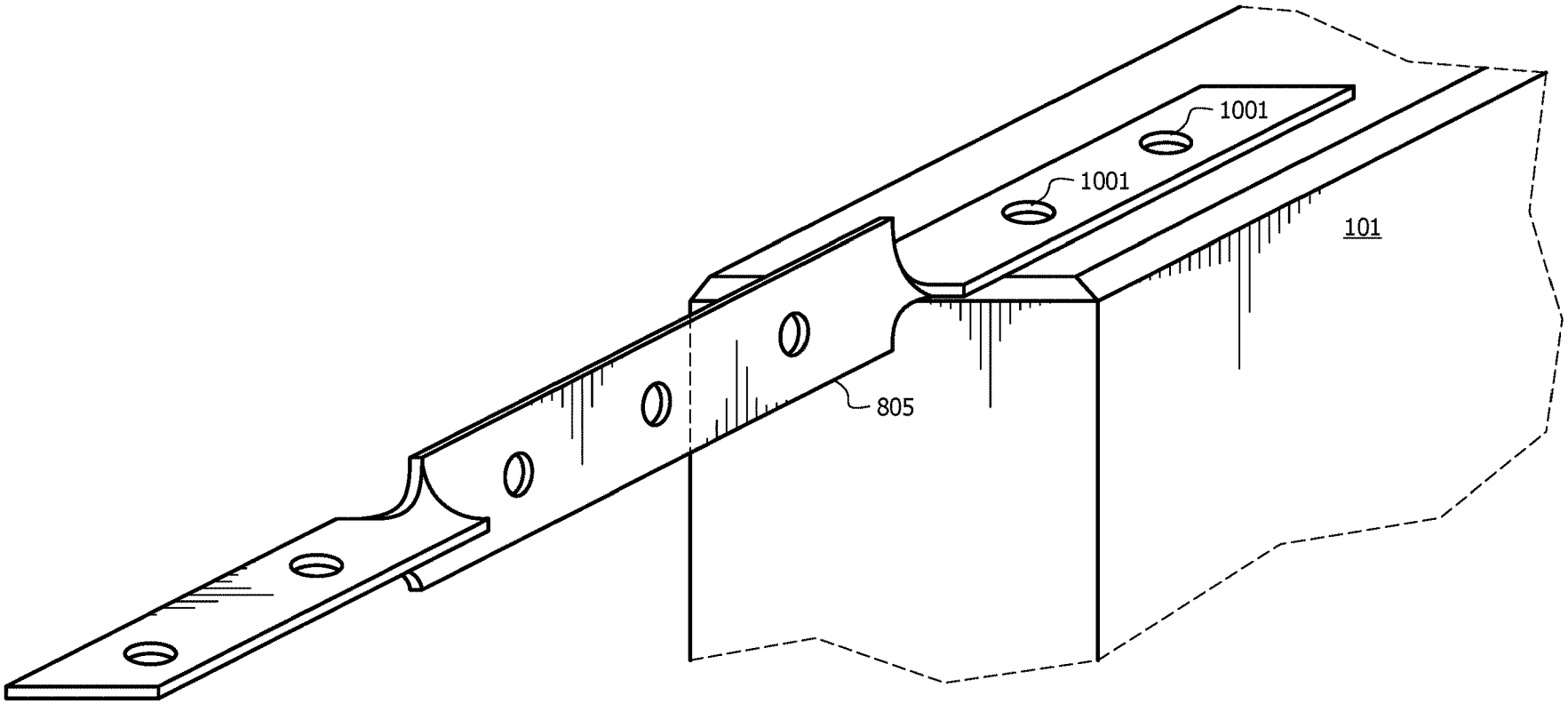
FIG. 12 depicts a perspective view of a straight panel tie according to an embodiment of the present disclosure.
Figure 13:
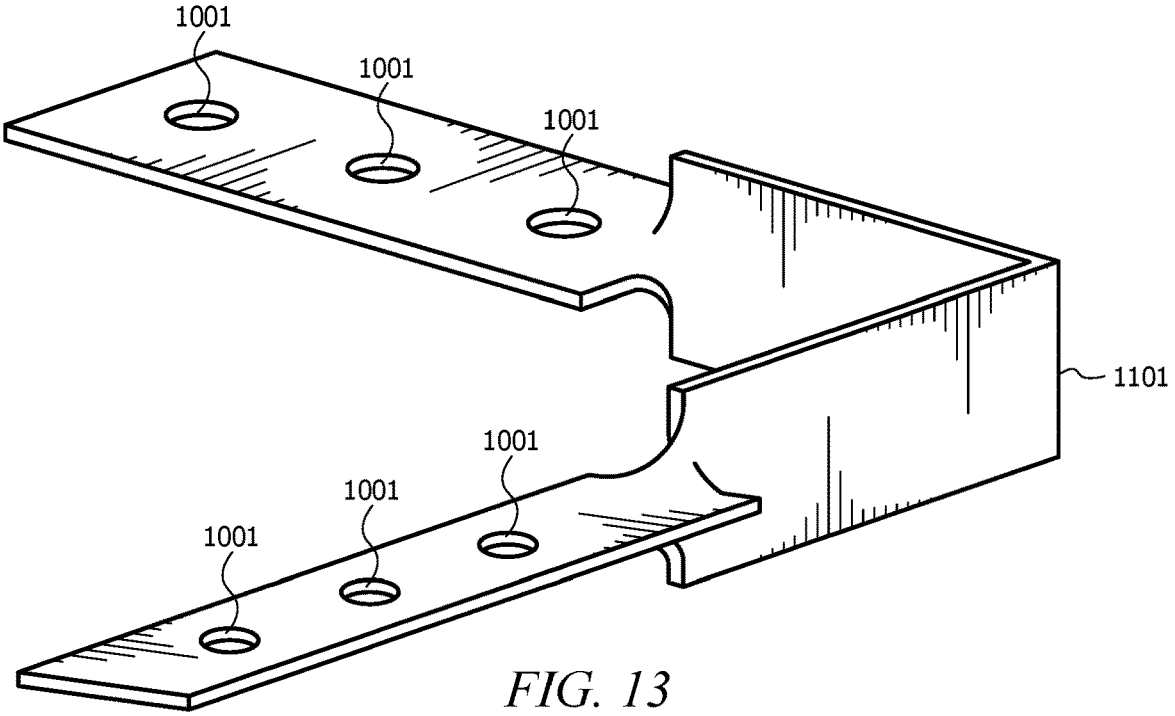
FIG. 13 depicts a perspective view of a corner panel tie according to an embodiment of the present disclosure.
Figure 14:
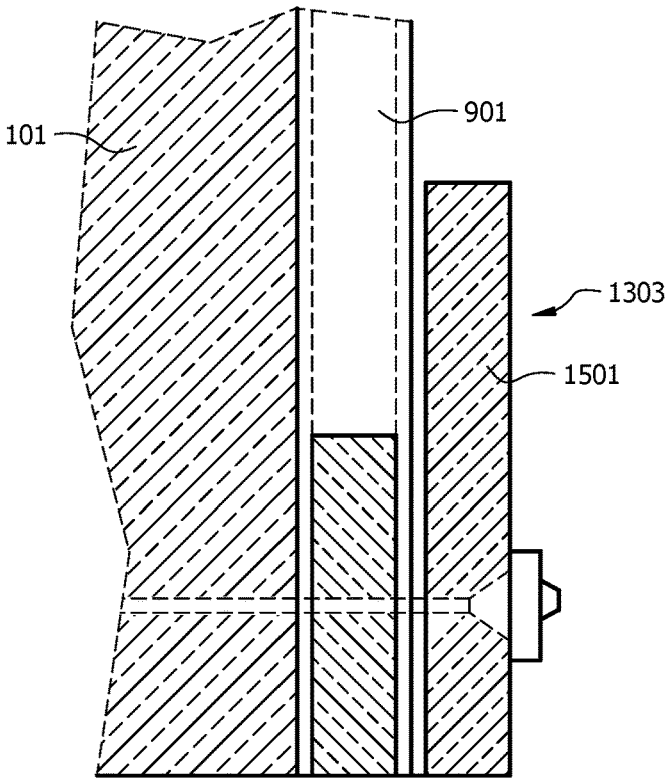
FIG. 14 depicts sectional view of a form and a fastener assembly according to an embodiment of the present disclosure.
Figure 15:
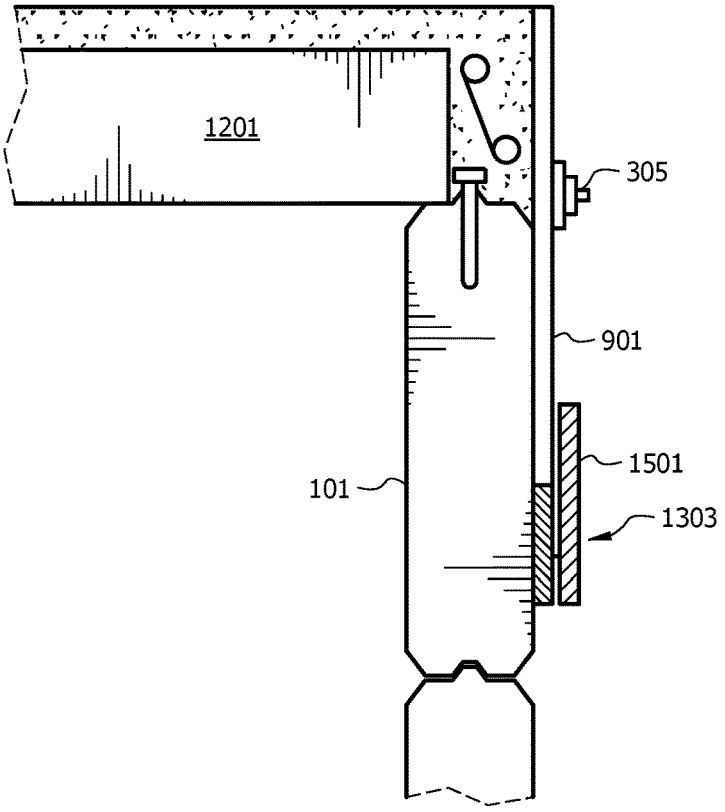
FIG. 15 depicts a section view of a panel wall with a ring/perimeter beam form and the bearing end of a floor plank according to an embodiment of the present disclosure.
Figure 16:
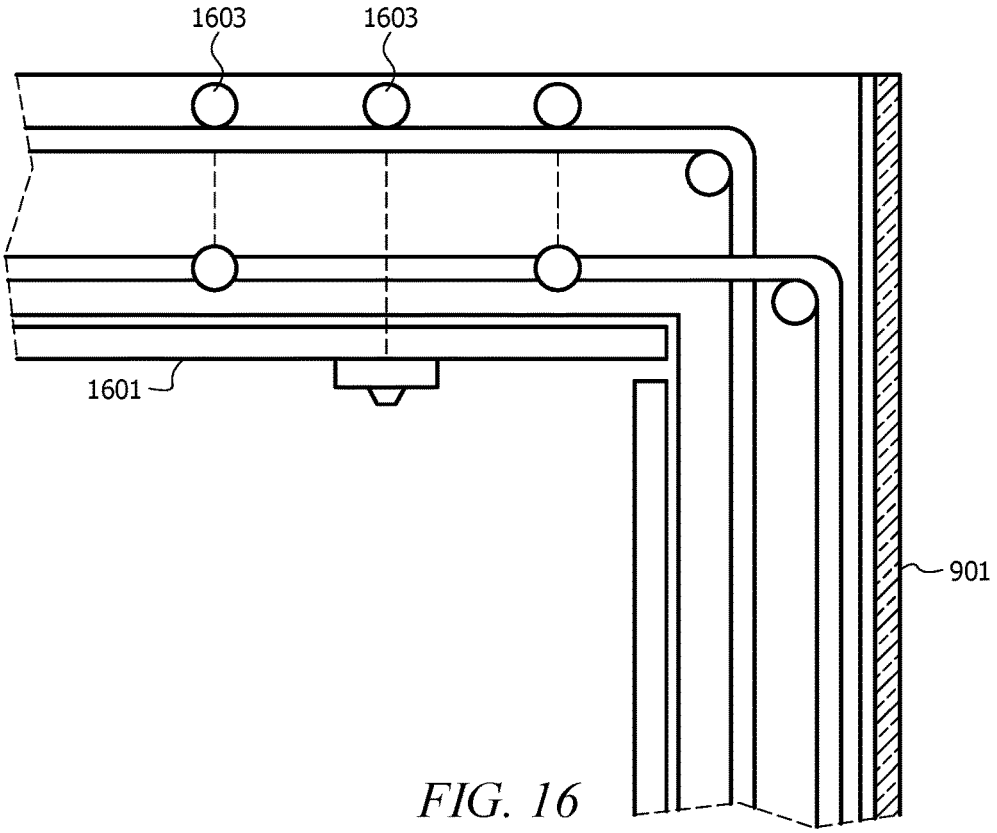
FIG. 16 depicts a side cross-sectional view of an integral floor plank beam and wall at an integral wall column and support system according to an embodiment of the present disclosure.
Figure 17:
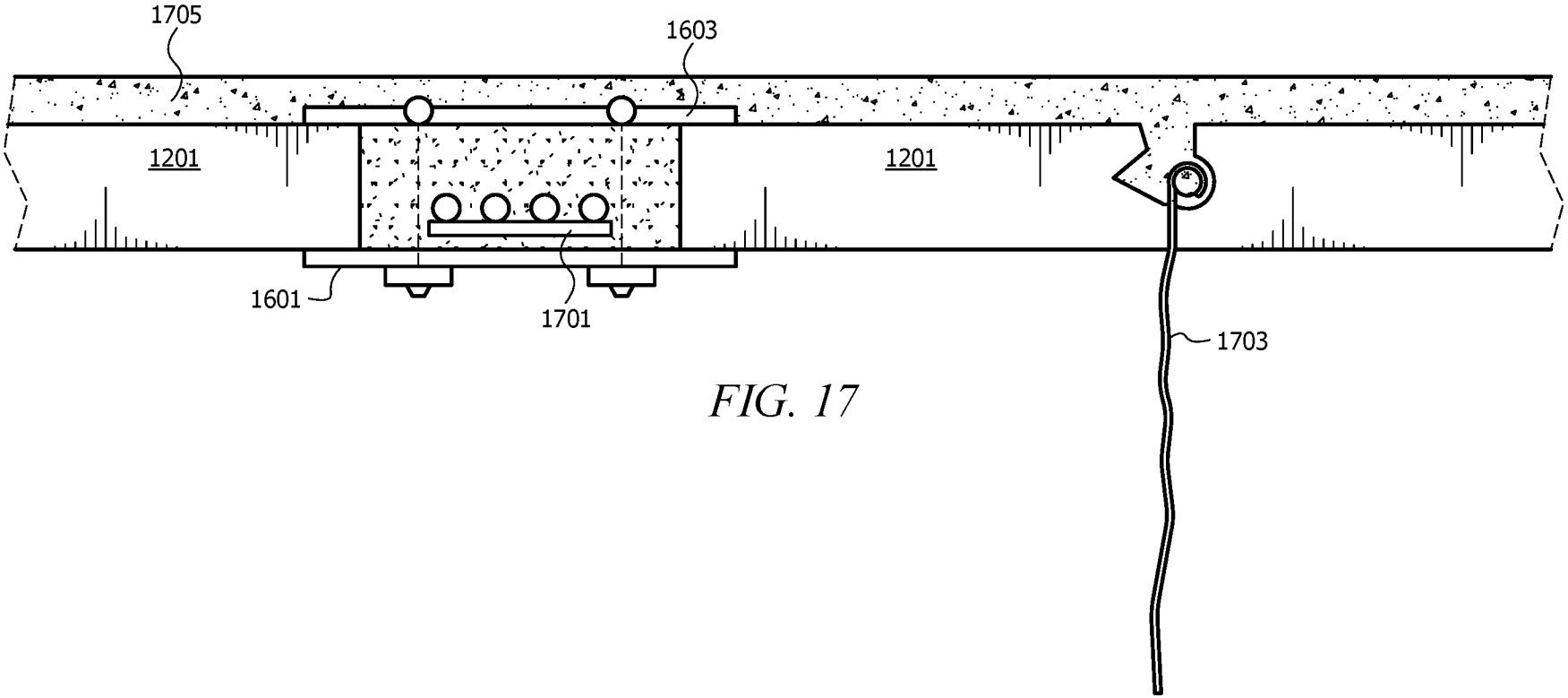
FIG. 17 depicts a section view of the floor planks at the integral floor plank beam and at a retention tie/rod for systems suspended from the AAC roof or upper story floor system and support system with floor planks according to an embodiment of the present disclosure.

Specific pre-erection tasks are undertaken to prepare the area. Wall panels 101 are tongue and groove to allow precise edge-to-edge fit and alignment. Some field fashioning and panel prep is required to accommodate the form ties 103 that pass through the walls at the panel joints 203, and "panel ties" 805 that connect panel ends to adjacent panels or to the integral column. Wall panels 101 arrive at the job site, reverse staged on delivery vehicles. The preferred method is to set the panels 101 and planks 1201 directly from a truck even if it requires using 2 cranes to expedite unloading. Not all site conditions will allow this. The wall panels 101 can be set on edge horizontally, with a gap of 6"-10" between the ends of the panels. This "gap" can eventually form the integral column element 307 of IMS (see FIG. 5). Wall panels 101 can be braced using struts 107 and forms 901 that have form ties 103 that extend through the wall system at the panel joints 203 (see FIGS. 1 and 6). The struts 107 can be fastened with removable lag bolts or other appropriate concrete anchors 109 to the foundation, or to the first (bottom) panel with a "though-bolt" 207 after the first panel is set. All anchors 109 and connections 801 should meet minimum requirements for the application and anchor substrate. If needed, the panels 101 are separated on the truck using a special lever/tool to give the worker space to prep the panel. Remove approximately 12-16 inches of panel "tongue" at each end of each panel (except the top and at wall openings) to accommodate the attachment of a "Panel Tie" 805, and form tie. An appropriate "panel tie" 805 (exact type, size, configuration, gauge, and material varies by location and environment) is attached on one panel end along the centerline of the top edge of the panel using standard/appropriate AAC fasteners 1001 (see FIG. 12). The "panel tie" 805 can extend about 18" beyond the end of the panel. This "panel tie" 805 can be fastened to the opposing panel. These "panel ties" 805 secure the ends of two panels 101 together and cross the gap between the panel ends (the gap of 6-10" that eventually becomes the concrete column element of the IMS). These "Panel Ties" 805 are approximately 30" long, made of a single continuous piece, and designed and fabricated so that the ends lay flat on the top edges of opposing panels, however the center section (the section that passes through the "gap" in which concrete can be poured) is twisted vertically to allow poured concrete to fall or pass by the "Panel Ties" and allow the concrete to completely fill the formed column (mid-wall columns 1207 and corner columns 1209) and properly consolidate within the formed cavity. Different shapes of panel ties 1101 can be used to form corners as seen in FIG. 13. Panel ties may also be bent in the shape of an "L" and "discontinuous" to allow some field tolerance flexibility. IN this case, two separate "panel ties" will be fastened to the ends of two opposing panels at the IMS column and will "anchor" in the cured cast in place concrete.

Figure 7:
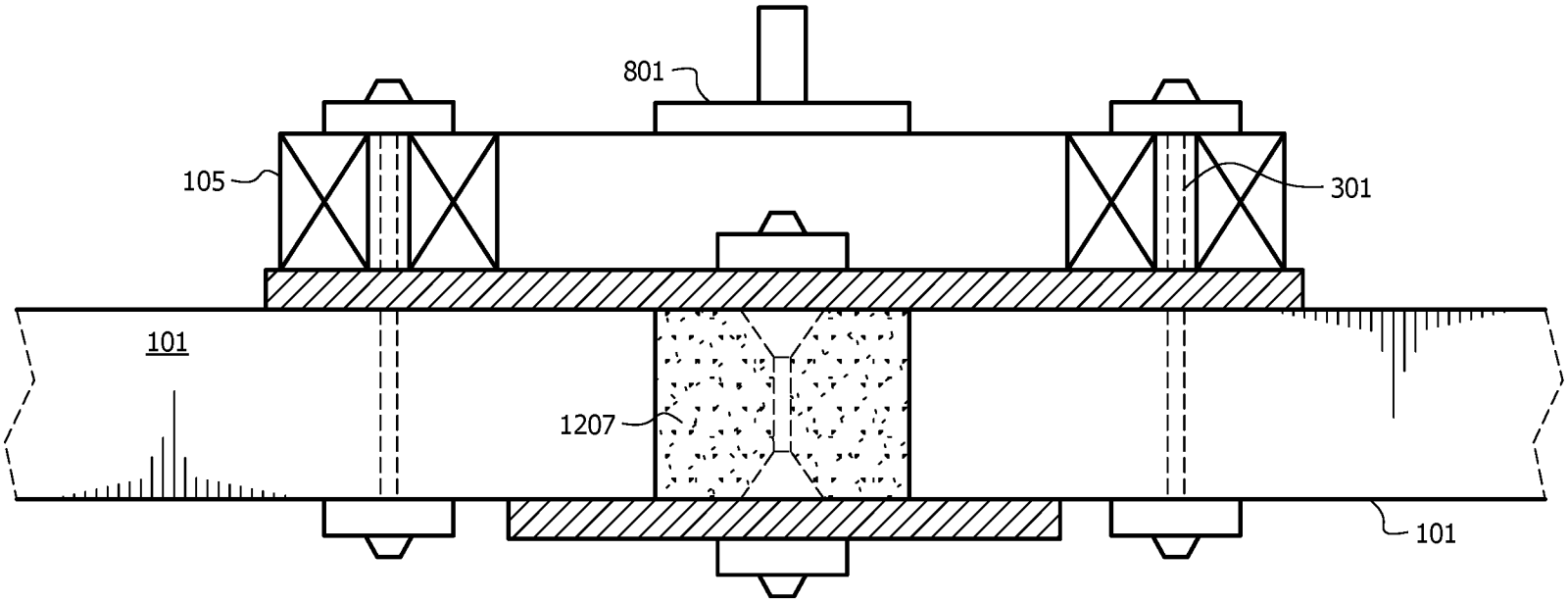
FIG. 7 depicts a plan view of a wall and form at an intermediate integral column according to an embodiment of the present disclosure.
Figure 8:
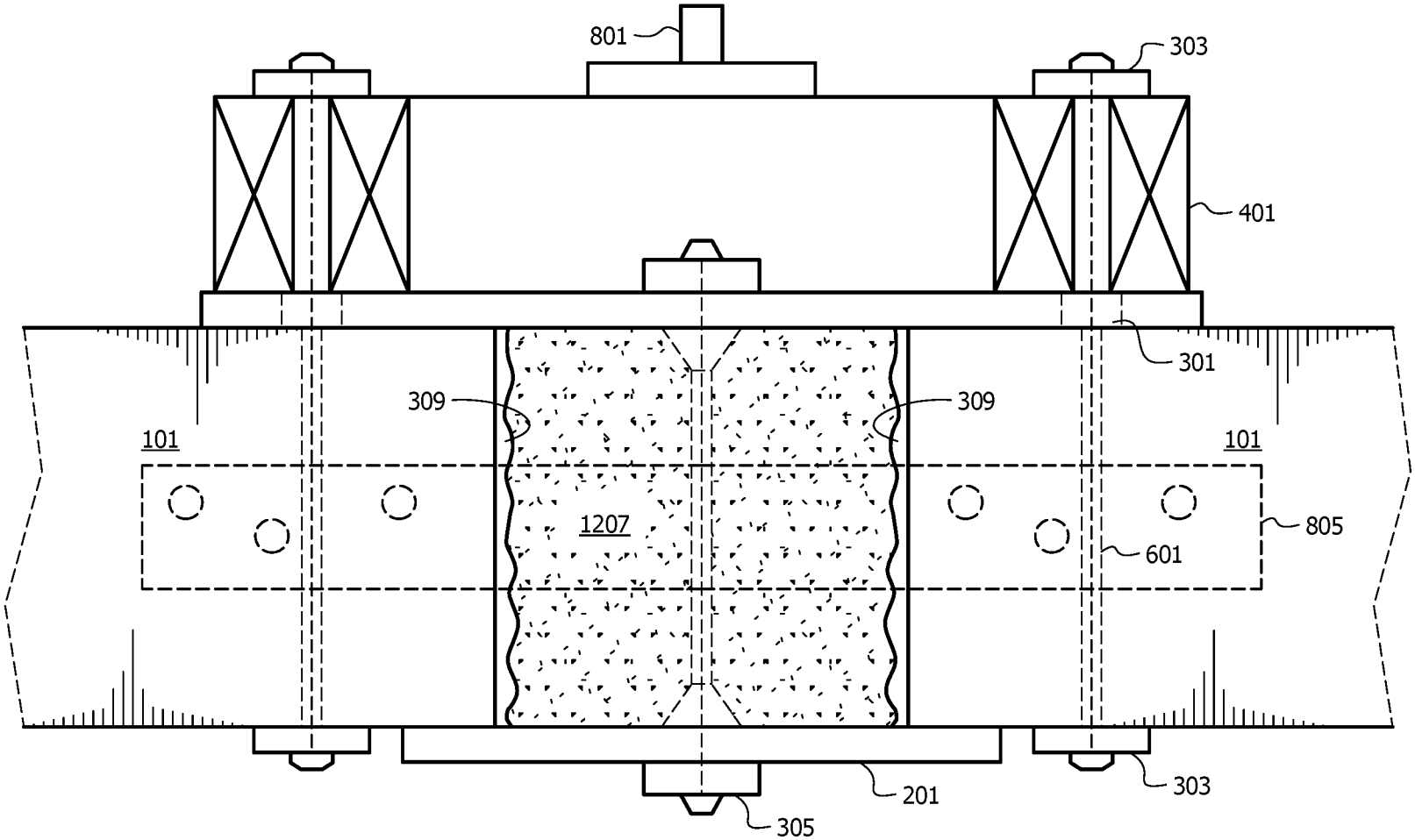
FIG. 8 depicts a plan view wall and concrete column with a form according to an embodiment of the present disclosure.
Figure 9A:
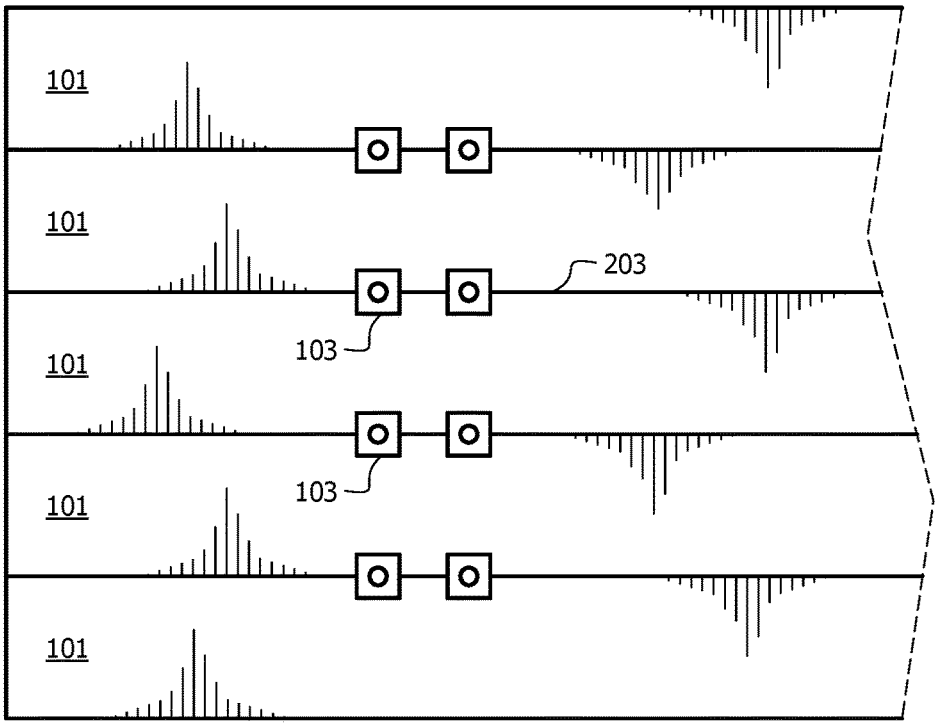
FIGS. 9A and 9B depict a front elevational view of a wall and shoring form and anti-buckling stiffener and intermediate wall shoring according to an embodiment of the present disclosure.
Figure 9B:
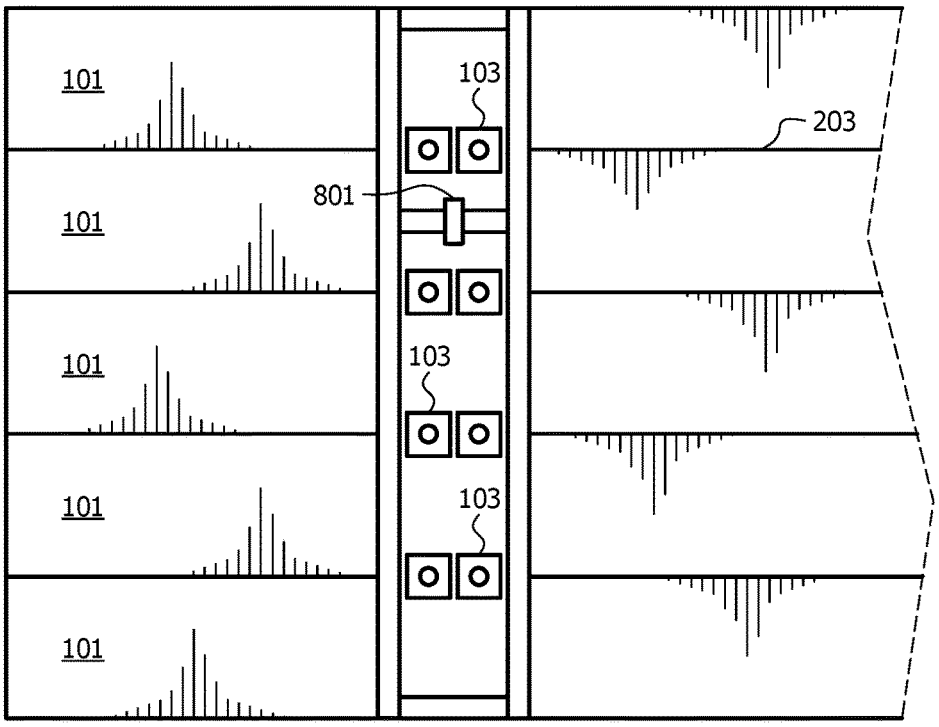
Figure 9C:
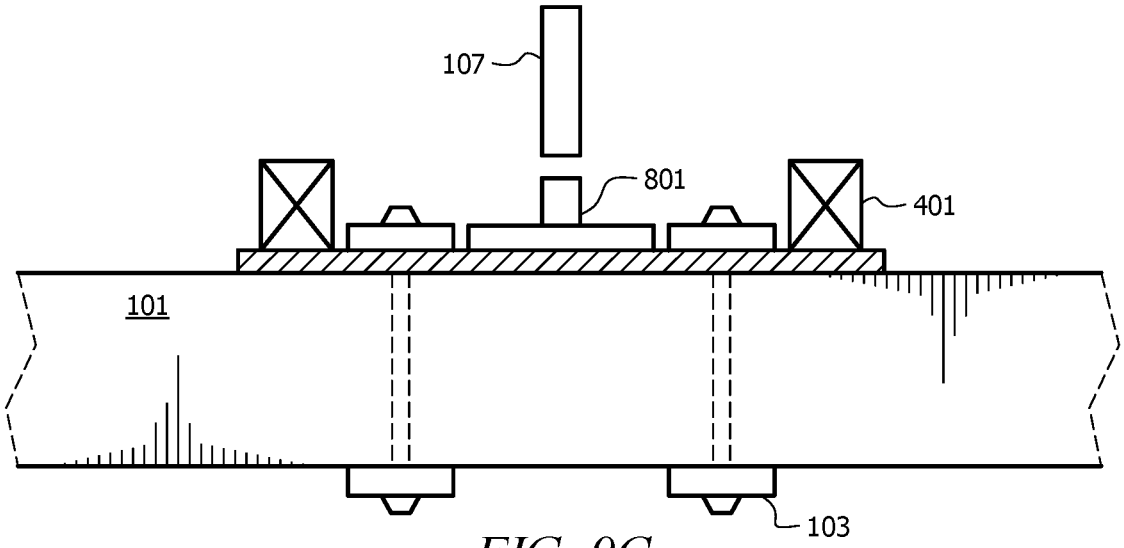
FIGS. 9C and 9D depict a plan view of a wall and form with a strut according to an embodiment of the present disclosure.
Figure 9D:
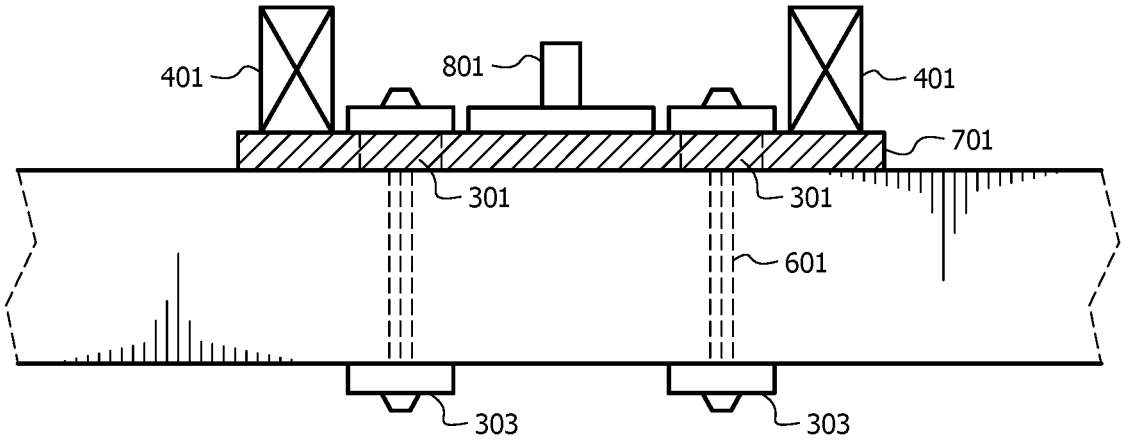
Figure 10A:
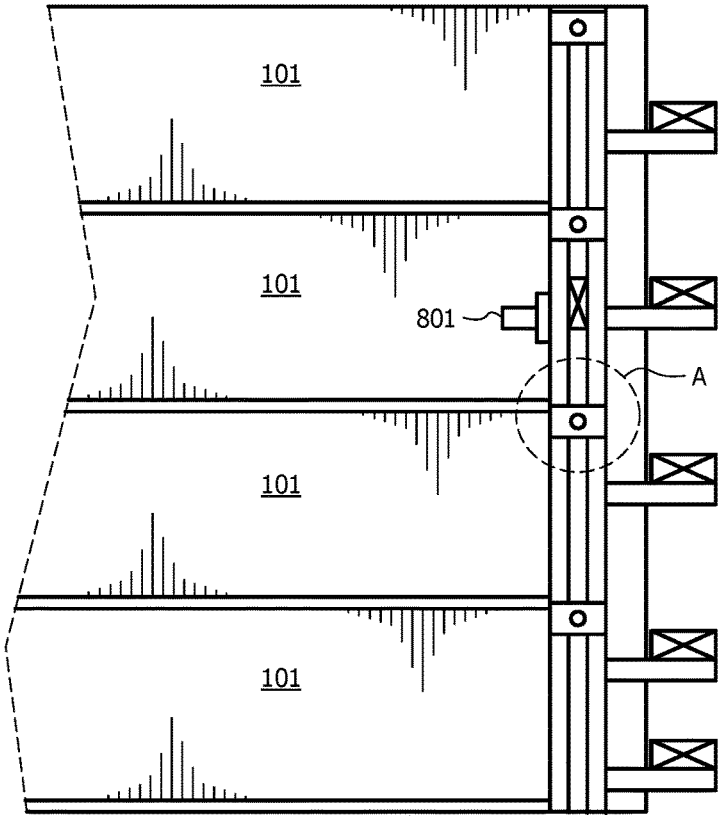
FIG. 10A depicts a front elevational view of a wall and a shoring form according to an embodiment of the present disclosure.
Figure 10B:
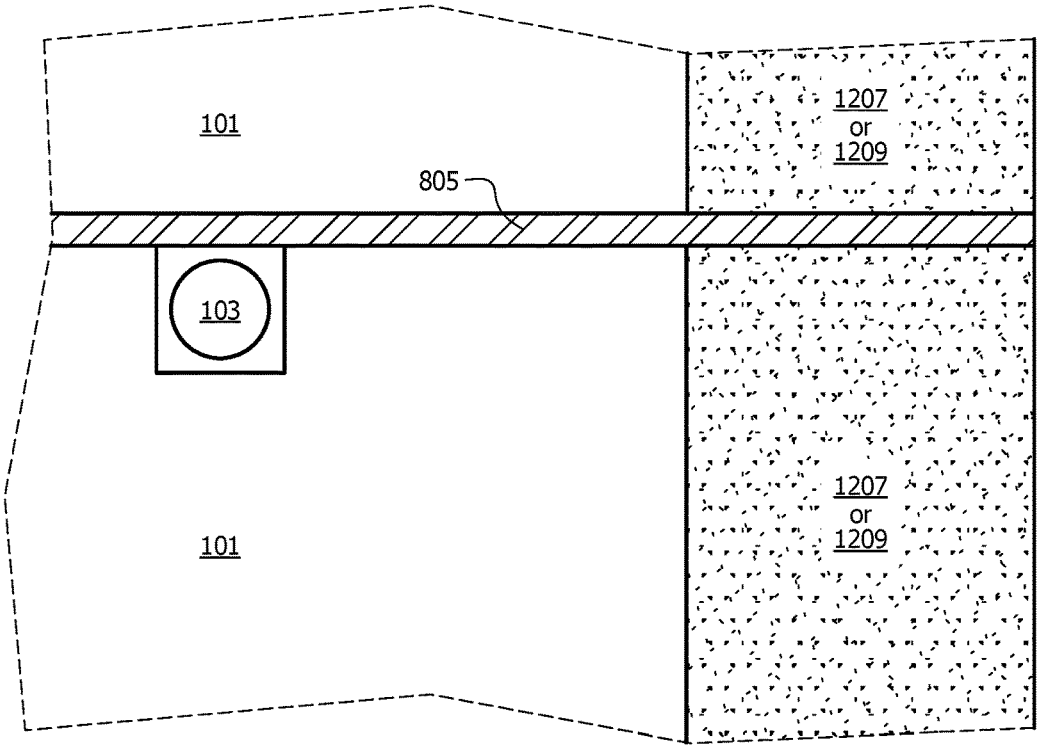
FIG. 10B depicts an enlargement of section A of FIG. 10A.

The vertical structural forms 401 have form ties 103 at four locations at each panel joint 203 and additional locations on walls that require intermediate "anti-buckling" bracing (see FIGS. 9A and 9B). The two outer form ties 103 (farthest away from the "gap" or end of the panels) allow the wall to be erected and braced from one side of the wall. These form ties 103 should be recessed below the top edge of wall panel, to allow clearance for the "panel ties/connectors" 805/801 that lay flat on the top edge of the panel at the integral column 803 locations (see FIG. 10B). The form ties should be sleeved to allow easy removal (use "She-bolts" or through bolts) (see FIGS. 9C and 9D). The tie holes 301 in the forms should be oversized (as seen in FIG. 7) to allow for field tolerance deviations and to plumb forms. The connectors 801 securing the forms 401 can be recessed into the forms 401 to allow the wall panels 101 to fit flush on the inside surface of the forms 401 without scraping against the screw or bolt heads. A piece of plywood 701 can be placed on the exterior of the wall panels 101 to ensure the forms 401 do not damage the wall panels 101. The two interior form ties 103 (closest to the "gap") are designed to secure the outer wall form 201 after the panels 101 are erected and the reinforcing steel is set (see FIG. 8). Along the centerline of the vertical forms are holes for conical (or other) "snap-ties" 305 to retain outer form panel and to prevent form blow-outs or bulging. Workers may cut a receiver for form ties 103, remove another section of the "tongue", and cut four shallow grooves at the top edge of the panel to accommodate the through-wall form ties 207 (or the sleeve 601) that pass through the panel joints 203 at these locations. Recessing the form ties 103 in the top edge of the panel is necessary so that the form ties 103 do not interfere with the "panel ties" 805 that are fastened to the top edge of the panel. The top panel requires additional prep to accommodate the horizontal c.i.p. perimeter/ring beams 1205 at the top of all walls and perimeter of the floor/roof planks. A worker may cut a reglet/receiver using a dado blade, or appropriate router bit, for the form ties (snap ties, she-bolts 303, through-wall sleeves 601, etc.). Alternatively, drill and set shield for perforated form strap may be used.

Figure 2:
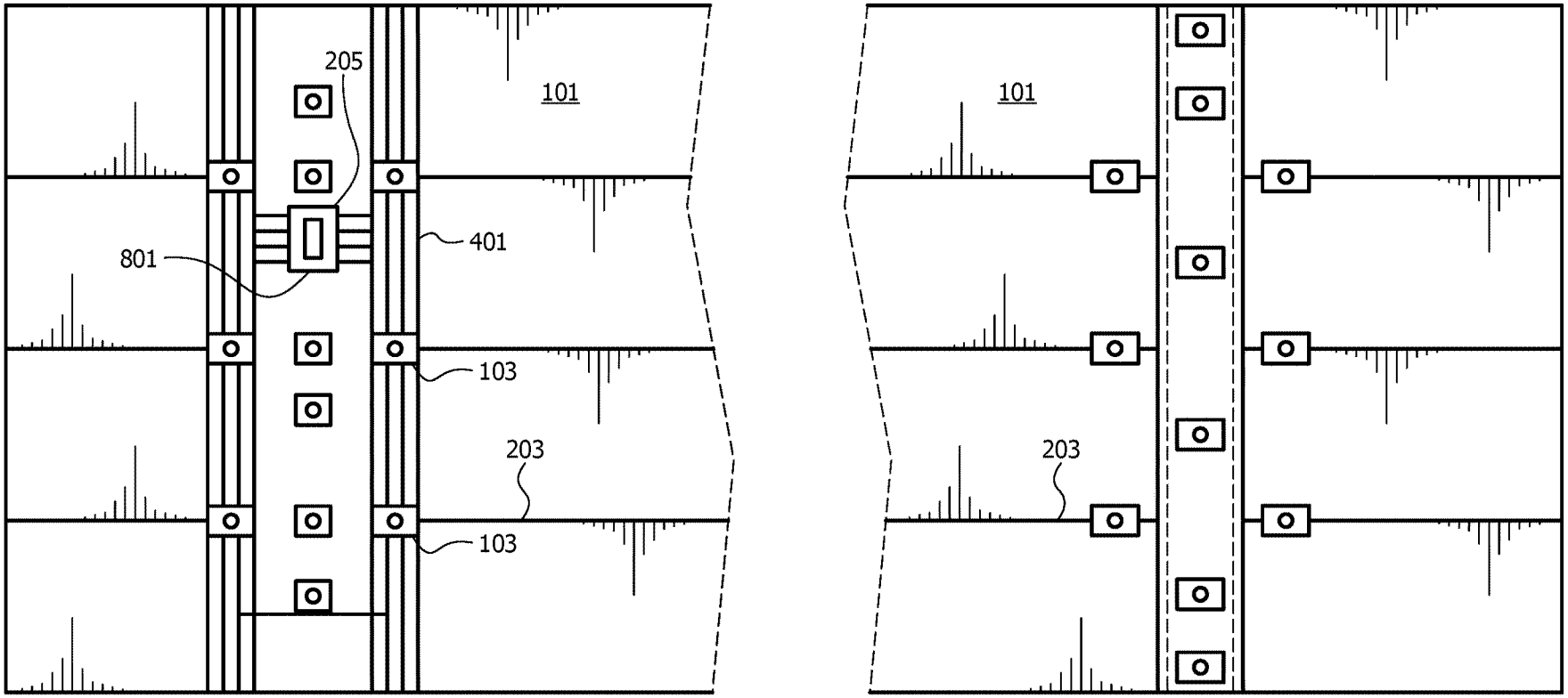
FIG. 2 depicts a front elevational view of a wall with forms and intermediate bracing/shores according to an embodiment of the present disclosure.
Figure 3:
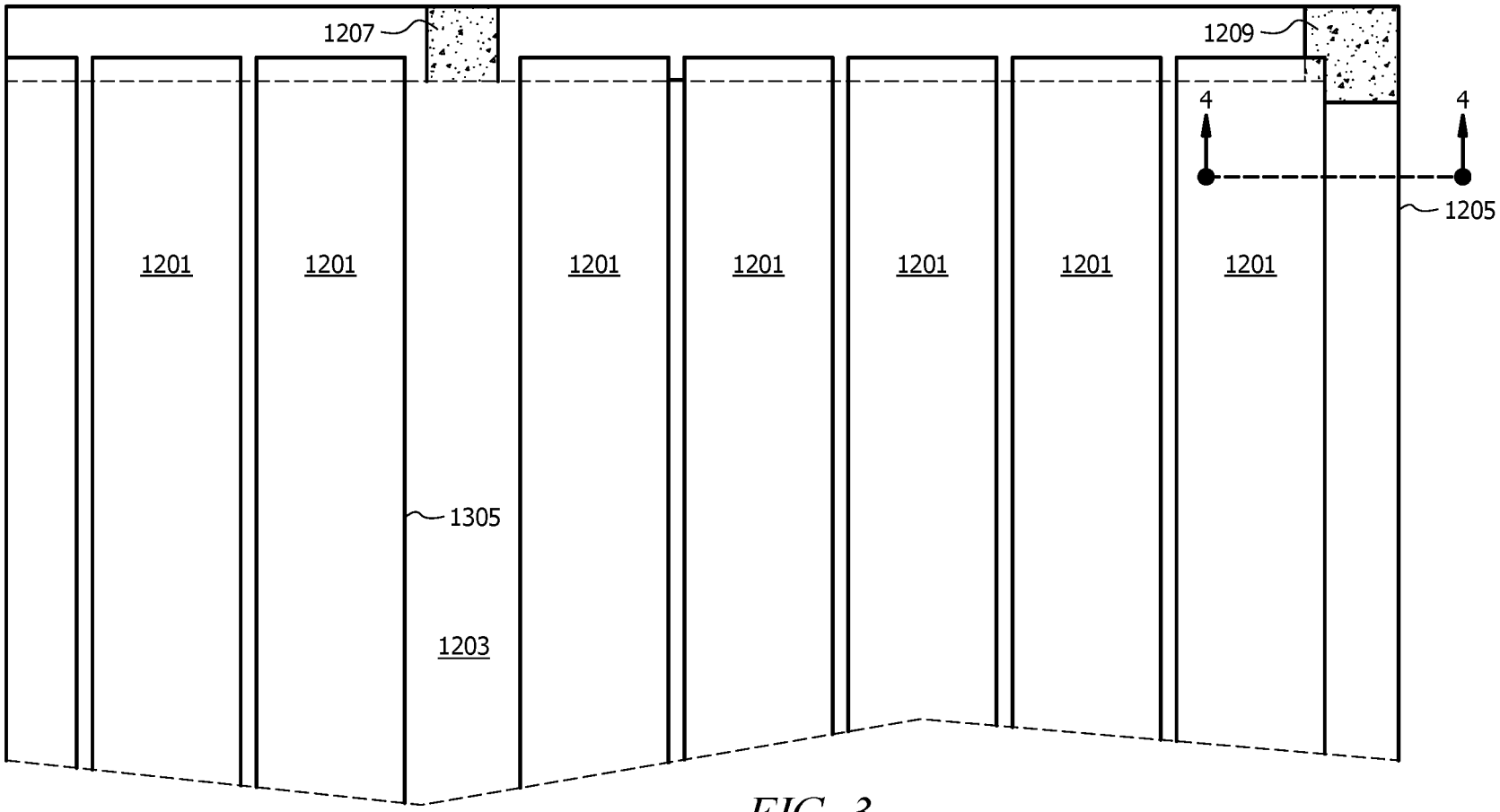
FIG. 3 depicts a plan view of a wall and a plurality of floor planks according to an embodiment of the present disclosure.
Figure 4:
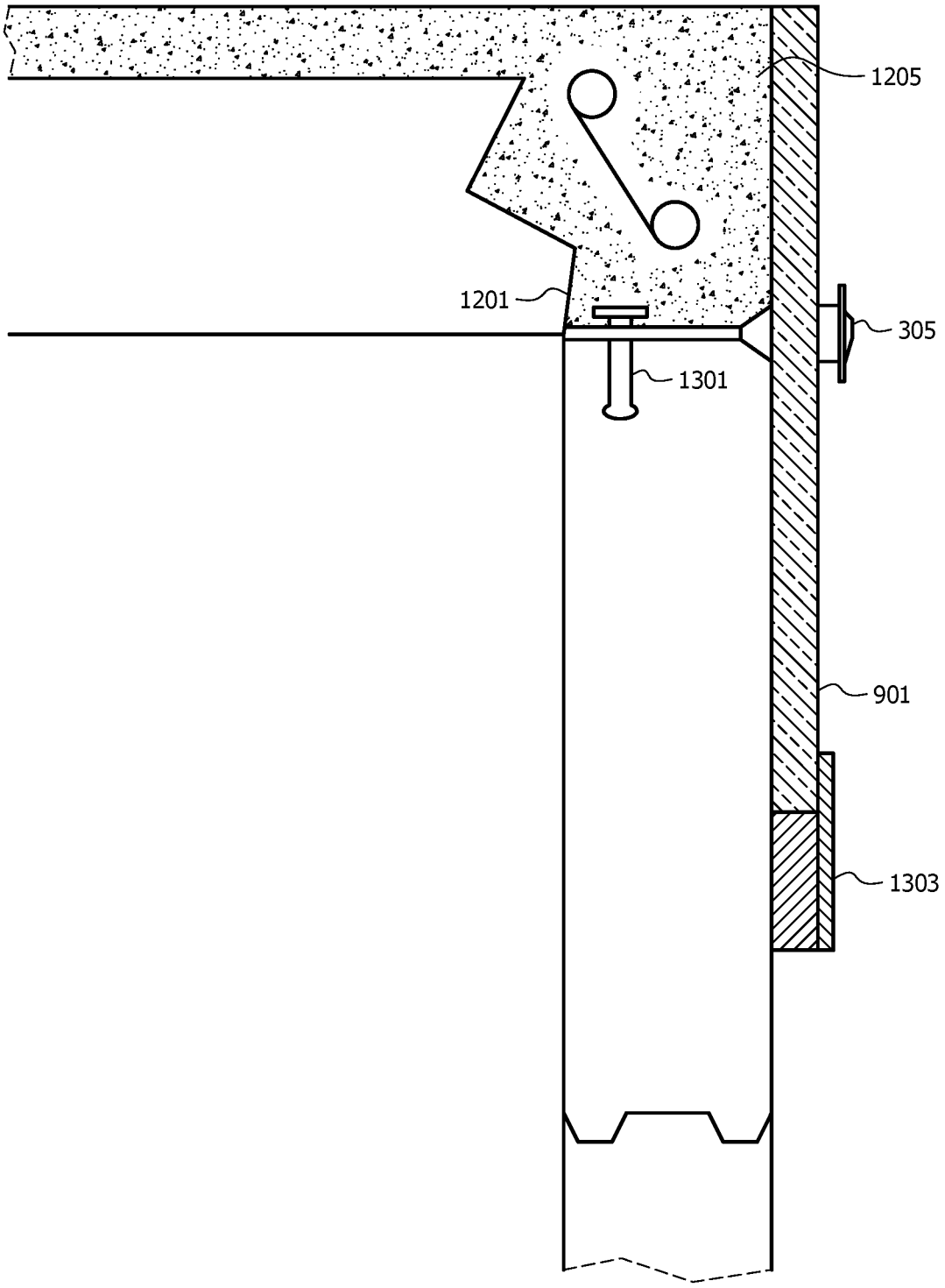
FIG. 4 depicts a section view of the top of a panel wall and side edge of floor plank according to an embodiment of the present disclosure, taken along site line 4-4 in FIG. 3.
Figure 11:
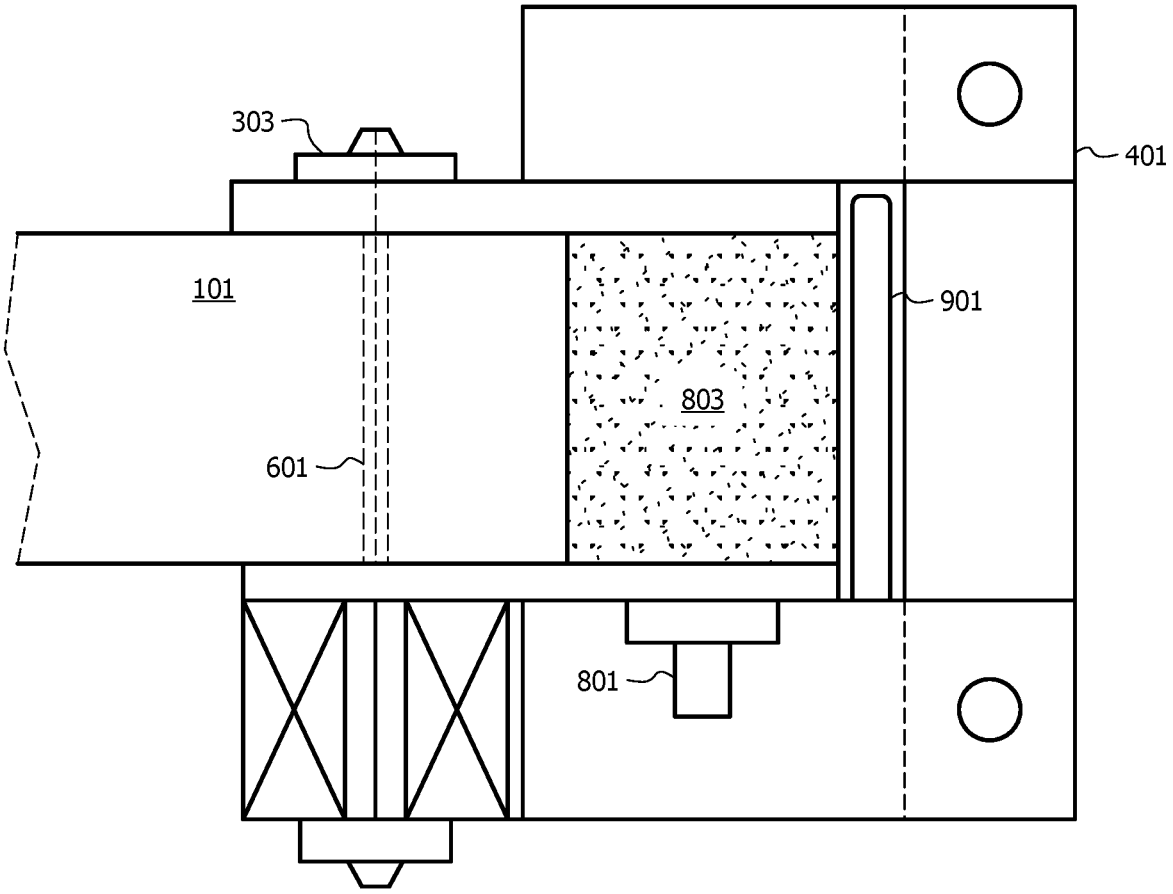
FIG. 11 depicts a plan view of an end of a wall and form with a strut cleat according to an embodiment of the present disclosure.

Once panel setting & erection (preliminary cutting, pre-drilling, trimming, etc.) for the "panel ties" 805, form ties 103 & anchors/fasteners 1301 has been completed, and a "panel tie" 805 is connected to one end of the panel 101, the panel 101 is hoisted to its final placement location in the system. Another worker can receive and guide the panel into place. That same worker can also: install form ties 103 at the ends of the panels; install form ties 103 at the locations of the intermediate "anti-buckling" bracing where needed; attach the loose end of the "panel tie" 805 on this panel 101, to the previously set panel on the opposite side of the "gap"; top panel—install "form tie" or perforated strap or sleeve for removable/reusable form tie; secure the outer form ties 103 with compatible form-tie ends (wale, wing nuts, or other base that allows minor adjustment and minor wall width fluctuations); secure and tighten the "form tie" 103 on the lower edge of the wall panel; install intermediate "anti-buckling" bracing/stiffeners 401/shoring struts 107/anchors 109 at midspan locations when/where there is a possibility of wall buckling (see FIGS. 2 and 6); and install chamfer strips where forms meet panels to create a reglet for crack isolation and caulking. Repeat this process for all panels 101. For top panel preparation see forming perimeter c.i.p. ring/perimeter beam 1205 in FIG. 11. Install the preferred form ties 103 on the top edge of the top panel 101 at specific locations to receive and secure perimeter beam forms 901. Apply bond-breaker 309 crack isolation membrane, expansion joint filler 209 as required to the surfaces of the AAC that come in contact with the case in place concrete of the IMS. Install column reinforcing per engineered drawing requirements. Patch, seal and form any locations that might have a potential for concrete slag leakage. Install AAC thin panels as form liners for additional insulation.

Floor plank erection and setting may be seen in FIGS. 3,4, 14-17. The planks are set on top of the walls being cognizant of bearing surface requirements. The planks can be used to form a horizontal surface of the IMS. Take "as-built" dimension of the distances between tops of the wall panels to be certain that minimum bearing surface requirements can be met. Adjust the struts 107 in or out to position the tops of the wall panels to confirm that minimum bearing surfaces are achieved. Walls may be out of plumb slightly to accommodate these requirements. If greater adjustments are required, loosen form tie bolts/wales/etc., adjust struts, then re-secure form ties. Start with the end planks 1201, placing planks 1201 side-by-side at both ends of the structure and work towards the "integral floor beam" 1203 (see detail 2D for section). Lay the first planks 1201 with the long edge of the plank 1201 either overlapping with the top edge of the end wall if the wall is lower than the bottom edge of the spanning plank, or just inside and abutting the upper edge of the parallel wall, if the wall is taller than the bottom corner/edge of the spanning plank (see FIGS. 4 and 15). Lay planks side-by-side starting at both end walls and progress to meet a midspan location, where there can be a strategic intentional gap 1305 that is designed to accommodate and absorb field tolerance issues. Gap 1305 may also create a structural load bearing beam 1203 that can accommodate concentrated loads from permanent construction above (column, stair system, etc.), where this beam is designed to be load bearing (deformed reinforced steel or post tension cabling). The beam should coincide with an integral wall column, when possible. The Soffit of this section shall be formed 1601 (see FIG. 16) from above using plywood 1501 that is suspended from above using adjustable form ties 305, cables 1701, rebar spanning the plank gap 1603, and tensioning devices 1703 to pull the forms flush and tight against the underside of the planks (see FIG. 17). Install chamfer strips along each panel edge, if preferred. Seal, patch, and form any gaps or areas where placed concrete slag may leak. Pre-run MEP service or anchors or floor penetrations (run/install after reinforcing steel is installed): pre-drill and install all anchors that can be used to suspend systems from the ceiling below; contact material manufacturer for location or reinforcing; run service conduit and plumbing as needed; install floor heating systems if utilized; form the perimeter of any floor openings such as stairs, scuttles, chase locations, roof/floor penetrations for Mechanical/Electrical/Plumbing (MEP); and install "block-outs" at any locations where other service penetrations might be required. Supplemental reinforcing and welded wire fabric (WWF) might be required a blockout corners and points prone to cracking.

The deformed and post-tension reinforcing steel is set/installed and any miscellaneous detailing is completed. Lay and chair reinforcing per that manufacturer's and/or structural engineer's requirements. Install perimeter reinforcing steel in the perimeter beams. Lay WWF if there is any possibility that the concrete topping 1705 may develop cracks. Reinforce openings as detailed by engineer. Install other imbedded devices, shoring/bracking anchors, davits, etc.

Remaining wall perimeter beam forms are installed. Fastener cleats 1303 on the face of the walls a distance below the top edge of the walls to support the perimeter beam form boards (as seen in the sectional view of FIG. 14), such that the top of the form boards is at the finish grade of the concrete topping 1705. The forms 901 can be secured flush to the wall panels 101 with plywood 1501. Forms must be precisely set if additional wall panels are to be erected (see FIG. 10A). Forms shall interlock at the end edges to prevent blow-outs. Forms are pre-drilled at specifical location to line up with the "form tie" locations. Form tie holes may be oversized to accommodate field tolerances. AAC panels may be pre-drilled to accept anchor and wall tie at these locations. Thin AAC panels may be installed as form liners for added insulation where dimensions accommodate them (8" and thicker wall panels). Bond breaker and expansion joint materials may also be installed to arrest/isolate cracks caused by cyclical movement and mitigate panel cracking.

One or more additional levels can be added to the building by repeating the above steps with further sets of planks and panels on top of the first level built. Additional levels can be the same size as the first level or a different size. If the additional level is the same size as the first level, the additional level walls can be placed at the point where the first level vertical walls meet the horizontal surface formed by the planks.

Place structural grout or small aggregate concrete mix. Consolidate, vibrate, and finish per engineering requirements. Allow concrete to cure to minimum required strengths. Mix strength of the concrete may be determined by the engineer. Roof pours are given a "crown" and slope of approximately 1/16" to 1/8" per ft to allow proper drainage.

Forms, bracing, shoring, removable anchors and struts are removed. Concrete is patched, additional thin AAC cladding is applied over exposed concrete to provide added insulation and a uniform surface for applied finishes.

Although the present disclosure and its advantages have been described in detail, it should be understood that various changes, substitutions and alterations can be made herein without departing from the spirit and scope of the disclosure as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure, processes, machines, manufacture, compositions of matter, means, methods, or steps, presently existing or later to be developed that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

What is claimed is:

1. A method for creating a building having an integral monolithic superstructure, the method comprising:

placing a foundation having a plurality of predetermined horizontally spaced apart column locations having a width;

setting a first set of vertically oriented shoring having a width adjacent to an interior side of the horizontally spaced apart column locations, the width being sufficiently wide to cover the interior side of each respective space for the vertical supporting columns to be formed in the horizontally spaced apart column locations and having a width, and a portion of the ends of the first set of construction material on either side of each of the horizontally spaced apart column locations;

placing a first set of vertically oriented construction materials that include planks, panels, or planks and panels comprising a foam material and having a length, width, ends, a thickness and lower and upper edges, the first set of construction materials being supported by the foundation on a construction site to form one or more vertical walls of the integral monolithic superstructure, the ends of the first set of construction materials being spaced apart horizontally and endwise on the foundation at the predetermined horizontally spaced apart column locations to leave a sufficient space for the vertical supporting columns but sufficiently close together that the first set of vertically oriented shoring covers a portion of the ends of the first set of construction material on either side of each of the horizontally spaced apart column locations;

setting a second set of vertically oriented shoring having a width adjacent to an exterior side of the horizontally spaced apart column locations, the width being sufficiently wide to cover the exterior side of the space for the vertical supporting columns and a portion of the ends of the first set of construction material on either side of each of the horizontally spaced apart column locations such that the space for each of the vertical supporting columns is substantially enclosed on all vertical sides;

placing a second set of construction materials that include planks, panels, or planks and panels on an inner portion of a topmost edge of the first set of construction materials to form a horizontal surface of the integral monolithic superstructure while leaving an outer portion of the top edge of the first set of construction materials uncovered by the horizontal surface, the horizontal surface having a thickness and an upper surface having a height greater than the height of the topmost horizontal edge of the first set of construction material;

placing a perimeter vertically oriented and horizontally elongated form around the topmost portion of the exterior perimeter of the upper portion of the first set of construction materials, the form having a top edge higher than the upper surface of the horizontal surface, the form in combination with the topmost horizontal edge of the first set of construction materials uncovered by the horizontal surface of the second set of construction materials, the adjacent edge of the horizontal surface, and the second set of vertically oriented shoring, forming an open-at-the-top generally circumferential space, the bottom portion of which is in communication with the upper ends of each of the horizontally spaced apart column locations;

pouring mortar, concrete or a mix thereof into the open-at-the-top generally circumferential space to substantially fill it and each of the horizontally spaced apart column locations, and to cover at least a portion of an upper surface of the horizontal surface of the second set of construction materials with a predetermined thickness of the mortar, concrete or a mix thereof;

allowing the mortar, concrete or a mix thereof to cure to a predetermined strength to form an integral monolithic portion of the superstructure comprising vertically oriented concrete columns in the horizontally spaced apart column locations, an interconnected circumferential ring beam in the open-at-the-top generally circumferential space, and a horizontal floor, ceiling or roof of predetermined thickness in the portion of the upper surface of the horizontal surface of the second set of construction material covered by the mortar, concrete or a mix thereof; and removing the first set of vertically oriented shoring and the second set of vertically oriented shoring while permanently retaining the foam material as part of the completed building having an integral monolithic superstructure.

2. The method of claim 1, wherein the first set of construction materials and the second set of construction materials comprise aerated autoclave concrete foam.

3. The method of claim 1, further comprising:

receiving a floor plan, a design plan, or a floor plan and a design plan for the integral monolithic superstructure.

4. The method of claim 3, further comprising:

reverse-staging the first set of construction materials and the second set of construction materials on a transportation vehicle in accordance with the design plan.

5. The method of claim 1, wherein setting of the second set of vertically oriented shoring is performed after placing the first set of construction materials and before placing the second set of construction materials.

6. The method of claim 5, wherein the shoring is held to the planks and panels with form ties, wherein the form ties are re-usable or disposable snap ties, she-bolts, wing-nuts, sleeved ties, or combinations thereof.

7. The method of claim 6, further comprising:

after placing the first set of construction materials, attaching panel connectors and the form ties to a top edge of at least one of the planks or panels of the first set of construction materials to bridge or enter a gap between the at least one of the planks or panels.

8. The method of claim 7, wherein a beam, column, or corner is cast in the gap and anchors at least a portion of one or more of the panel connectors.

9. The method of claim 1, further comprising:

after the step of placing first set of construction materials and after the step of placing the second set of construction materials, attaching or installing one or more concrete reinforcing components to the first set of construction materials to reinforce the second set of construction materials.

10. The method of claim 9, wherein the concrete reinforcing components include post-tension reinforcing cables, rebar bridges, rebar, soffit beam forms, conduits, busways, suspension wires, suspension cables, suspension rods, or combinations thereof.

11. The method of claim 9, wherein the step of attaching or installing is performed prior to the step of pouring.

12. The method of claim 9, wherein the step of attaching or installing is performed after the step of setting.

13. The method of claim 9, wherein the step of setting is performed after placing the first set and before placing the second set.

14. The method of claim 1, further comprising:

patching or forming joints and gaps between the construction materials of the first set, between the construction materials of the second set, or between construction materials of the first set and the construction materials of the second set.

15. The method of claim 1, wherein the integral monolithic portion of the superstructure comprises vertically oriented concrete columns in the spaced apart column locations, and the circumferential ring beam in the open-at-the-top of the generally circumferential space are comprised of structural grout, concrete, rebar, steel, post-tension cables, or combinations thereof.

16. The method of claim 1, further comprising:

placing a third set of construction materials that include planks, panels, or planks and panels comprising a foam material at a connection point of the first set of construction materials and the second set of construction materials forming an additional set of one or more vertical walls of the integral monolithic superstructure; and placing a fourth set of construction materials that include planks, panels, or planks and panels comprising a foam material on a top edge of the third set of construction materials to form a second horizontal surface of the integral monolithic superstructure.

17. The method of claim 16, wherein the third set of construction materials is placed on a top surface of the second set of construction materials to form one or more perimeter walls or interior walls.

18. The method of claim 1, wherein the first set of construction materials form a perimeter of the integral monolithic superstructure.

* * * * *